US011454102B2

(12) United States Patent
Wessling et al.

(10) Patent No.: US 11,454,102 B2
(45) Date of Patent: Sep. 27, 2022

(54) METHODS AND SYSTEMS FOR OPTIMIZING A DRILLING OPERATION BASED ON MULTIPLE FORMATION MEASUREMENTS

(71) Applicants: Stefan Wessling, Hannover (DE); Matthias Meister, Celle (DE); Andreas Hartmann, Celle (DE)

(72) Inventors: Stefan Wessling, Hannover (DE); Matthias Meister, Celle (DE); Andreas Hartmann, Celle (DE)

(73) Assignee: BAKER HUGHES, LLC, Houston, TX (US)

( * ) Notice: Subject to any disclaimer, the term of this patent is extended or adjusted under 35 U.S.C. 154(b) by 899 days.

(21) Appl. No.: 15/151,644

(22) Filed: May 11, 2016

(65) Prior Publication Data

US 2017/0328191 A1 Nov. 16, 2017

(51) Int. Cl.

| | |
|---|---|
| ***E21B 44/00*** | (2006.01) |
| ***E21B 49/00*** | (2006.01) |
| ***E21B 7/04*** | (2006.01) |
| ***E21B 47/00*** | (2012.01) |

(52) U.S. Cl.

CPC ..... *E21B 44/00* (2013.01); *E21B 7/04* (2013.01); *E21B 47/00* (2013.01); *E21B 49/003* (2013.01)

(58) Field of Classification Search

CPC ..... E21B 44/00; E21B 47/00; E21B 49/003; E21B 7/04

USPC ..... 703/10, 2

See application file for complete search history.

(56) References Cited

U.S. PATENT DOCUMENTS

| | | | | |
|---|---|---|---|---|
| 6,246,963 | B1 * | 6/2001 | Cross | G01V 11/00 702/14 |
| 6,393,363 | B1 | 5/2002 | Wilt et al. | |
| 6,541,975 | B2 | 4/2003 | Strack | |
| 6,671,623 | B1 | 12/2003 | Li | |
| 6,903,553 | B2 | 6/2005 | Itskovich et al. | |
| 6,968,909 | B2 * | 11/2005 | Aldred | E21B 49/003 175/26 |
| 7,046,009 | B2 | 5/2006 | Itskovich | |
| 7,063,174 | B2 | 6/2006 | Chemali et al. | |

(Continued)

FOREIGN PATENT DOCUMENTS

WO 2010101473 A1 9/2010

OTHER PUBLICATIONS

Daoud et al., "3D Field-Scale Automatic History Matching Using Adjoint Sensitivities and Generalized Travel-Time Inversion", 2005, SPE 101779 Annual Tech. Conf. & Exh., 18 pgs.*

(Continued)

*Primary Examiner* — Juan C Ochoa

(74) *Attorney, Agent, or Firm* — Cantor Colburn LLP

(57) ABSTRACT

Methods and systems for optimizing drilling operations in a wellbore using a drill string are provided. The methods and systems include measuring a first formation characteristic with at least one sensor, measuring a second formation characteristic by means of a hydraulic test, the at least one second formation characteristic being different from the at least one first formation characteristic, generating a model to represent a formation around the wellbore, the model incorporating the first formation characteristic and the second formation characteristic, and performing a drilling operation based on the generated model.

19 Claims, 5 Drawing Sheets

(56) References Cited

U.S. PATENT DOCUMENTS 7,141,981 B2 11/2006 Folberth et al.
7,260,478 B2 8/2007 Dubourg et al.
7,483,793 B2 1/2009 Wang et al.
7,723,991 B2 5/2010 Signorelli et al.
7,751,280 B2 * 7/2010 Denichou ..... G01V 11/00 367/73
7,778,811 B2 * 8/2010 Kelfoun ..... E21B 7/046 703/10
7,912,648 B2 3/2011 Tang
8,008,919 B2 8/2011 Wang et al.
8,055,448 B2 11/2011 Mathiszik et al.
8,085,050 B2 12/2011 Bittar et al.
8,126,650 B2 2/2012 Lu et al.
8,239,172 B2 8/2012 Reiderman et al.
8,364,404 B2 1/2013 Legendre et al.
8,489,375 B2 7/2013 Omeragic
8,527,248 B2 9/2013 Thambynayagam et al.
8,538,699 B2 * 9/2013 Jing ..... G01V 3/12 702/7
8,756,018 B2 6/2014 Johnston et al.
8,770,284 B2 * 7/2014 Meurer ..... E21B 36/04 166/248
8,818,779 B2 * 8/2014 Sadlier ..... E21B 44/00 175/24
8,829,909 B2 9/2014 Tabarovsky
8,923,094 B2 * 12/2014 Jing ..... G01V 1/28 367/73
9,135,475 B2 * 9/2015 Lecerf ..... E21B 43/00
9,175,557 B2 * 11/2015 Iversen ..... E21B 44/00
9,228,425 B2 * 1/2016 Ganguly ..... E21B 43/26
9,556,720 B2 * 1/2017 Onda ..... E21B 43/26
10,385,686 B2 * 8/2019 James ..... E21B 49/008
2002/0099504 A1 * 7/2002 Cross ..... G01V 11/00 702/2
2003/0216897 A1 * 11/2003 Endres ..... G01V 99/005 703/10
2004/0140801 A1 * 7/2004 Schoen ..... G01V 3/32 324/303
2005/0216198 A1 * 9/2005 Craig ..... E21B 49/008 702/12
2008/0236842 A1 * 10/2008 Bhavsar ..... E21B 41/02 166/381
2011/0108283 A1 * 5/2011 Srnka ..... G01V 11/00 166/369
2011/0153296 A1 6/2011 Sadlier et al.
2011/0257944 A1 * 10/2011 Du ..... E21B 43/267 703/2
2012/0185225 A1 7/2012 Onda et al.
2012/0228027 A1 * 9/2012 Sehsah ..... E21B 49/008 175/48
2012/0298420 A1 11/2012 Seydoux et al.
2013/0144529 A1 * 6/2013 Seydoux ..... G01V 3/20 702/7
2013/0186688 A1 * 7/2013 Rasmus ..... E21B 47/06 175/48
2013/0226461 A1 8/2013 Yu et al.
2014/0350859 A1 11/2014 Lin et al.
2015/0035536 A1 2/2015 Tang
2015/0083401 A1 3/2015 Saeed
2015/0301222 A1 * 10/2015 Davydychev ..... G01V 3/28 324/338
2016/0116638 A1 * 4/2016 Kuchuk ..... G06Q 10/04 703/2
2016/0178798 A1 * 6/2016 Holland ..... G01V 99/005 703/2

OTHER PUBLICATIONS

Rabinovich, et al. "Deep? How deep and what? The vagaries and myths of 'look around' deep-resistivity measurements while drilling", SPWLA 52nd Annual Logging Symposium, May 14-18, 2011; 15 pages.
International Search Report, International Application No. PCT/US2017/031526, dated Aug. 2, 2017, Korean Intellectual Property Office; International Search Report 5 pages.
International Written Opinion, International Application No. PCT/US2017/031526, dated Aug. 2, 2017, Korean Intellectual Property Office; International Written Opinion 8 pages.

* cited by examiner

METHODS AND SYSTEMS FOR OPTIMIZING A DRILLING OPERATION BASED ON MULTIPLE FORMATION MEASUREMENTS

BACKGROUND

Since the beginning of shale development and production therefrom, drilling and completing as many wells as possible in the least time has been and continues to be an important focus of optimization. Time and cost are easy to measure and the industry has made enormous strides in reducing both days and cost-per-foot for a completed well. Determining where a drill string and/or drilling tool relative to various formations downhole is an important factor for optimizing drilling and making drilling decisions. For example, knowing properties of the formation surrounding the drilling tool can influence geosteering and/or other drilling operations and/or related aspects of drilling, including drilling mud characteristics, directional drilling, rate of penetration etc.

There are various ways for measuring characteristics downhole, and using the measured information to make drilling decisions. However, due to the nature of downhole operations and characteristics, multiple models of downhole conditions and/or environment can be found to satisfy measured data. Thus it is desired to have processes to obtain the most accurate modeling and/or limiting the number of possible models that are used for making drilling decisions.

SUMMARY

Methods and systems for optimizing drilling operations in a wellbore using a drill string are provided. The methods and systems include measuring a first formation characteristic with at least one sensor, measuring a second formation characteristic by means of a hydraulic test, the at least one second formation characteristic being different from the at least one first formation characteristic, generating a model to represent a formation around the wellbore, the model incorporating the first formation characteristic and the second formation characteristic, and performing a drilling operation based on the generated model.

BRIEF DESCRIPTION OF THE DRAWINGS

The following descriptions should not be considered limiting in any way. With reference to the accompanying drawings, like elements are numbered alike.

The detailed description explains embodiments of the present disclosure, together with advantages and features, by way of example with reference to the drawings.

DETAILED DESCRIPTION

A detailed description of one or more embodiments of the disclosed apparatuses and methods presented herein are presented by way of exemplification and not limitation, with reference made to the appended figures.

Disclosed are methods and systems for optimizing drilling operations for drilling wellbores. Embodiments of the present disclosure relate to navigating a wellbore through a reservoir by means of conducting multiple measurements and interpreting the measurements to characterize the reservoir around the wellbore in order to make steering decisions. More specifically, embodiments provided herein involve conducting a resistivity, electromagnetic, or acoustic measurement to determine reservoir architecture around the wellbore and conducting a hydraulic test using a formation testing tool. The hydraulic test results are analyzed to constrain the reservoir architecture around the wellbore (e.g., as obtained from the resistivity electromagnetic, or acoustic measurements). Embodiments provided herein provide a way that the combined interpretation of hydraulic tests and acoustic, electromagnetic, and resistivity data can be used to reduce uncertainty of the formation and reservoir properties around the wellbore. Whereas one isolated measurement can be explained by a large number of formation models, this combination reduces the amount of models which are able to explain all acquired data. Fitting between the model and the measurements can be either conducted automatically using appropriate inversion algorithms or manually by adjusting the model parameters (forward modeling).

Figure 1:
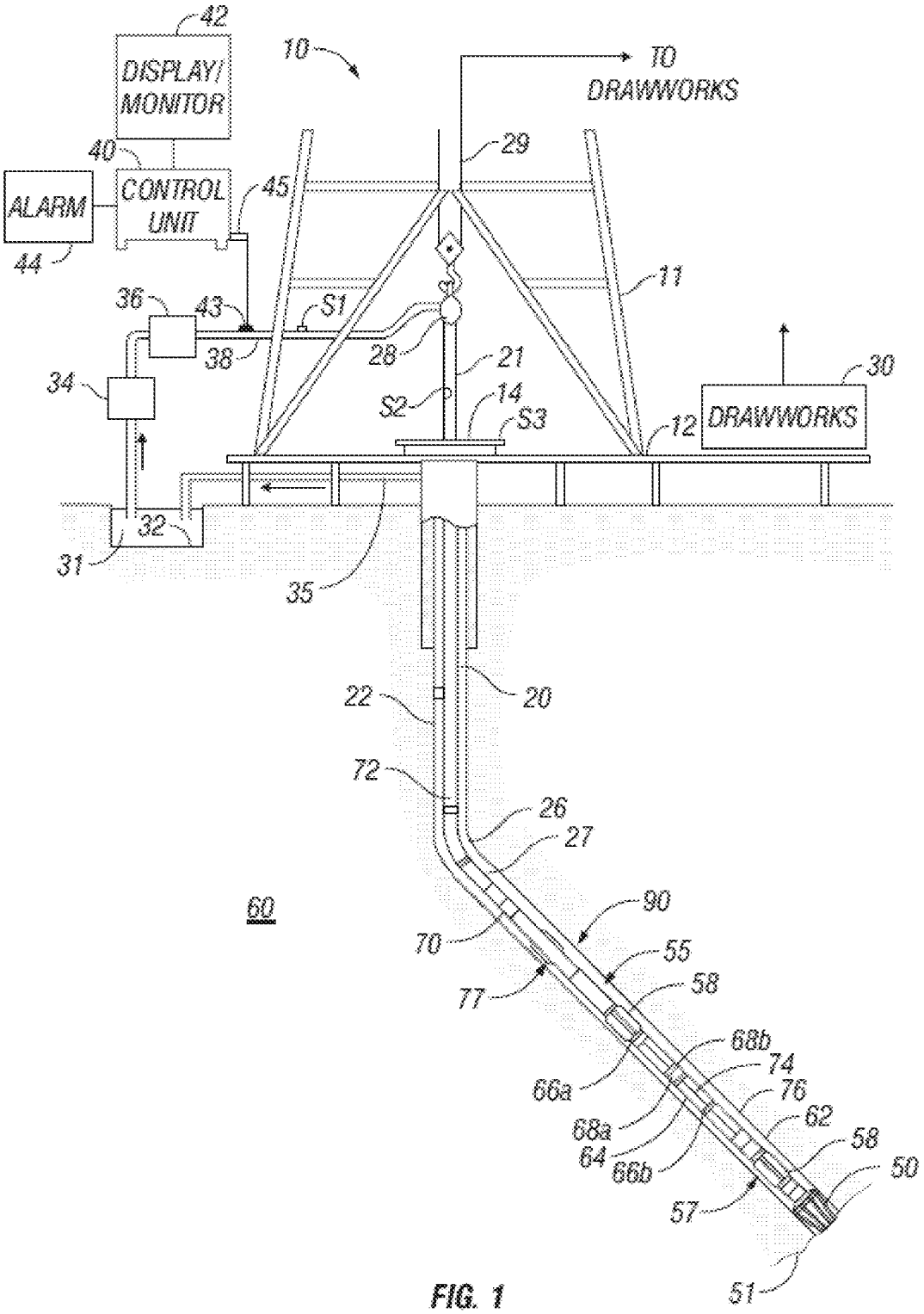
FIG. 1 is a schematic illustration of an embodiment of a downhole drilling, monitoring, evaluation, exploration, and/or production system in accordance with an embodiment of the present disclosure.

FIG. 1 shows a schematic diagram of a drilling system 10 that includes a drill string 20 having a drilling assembly 90, also referred to as a bottomhole assembly (BHA), conveyed in a wellbore 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the wellbore 26. A drill bit 50, attached to the end of the BHA 90, disintegrates the geological formations when it is rotated to drill the wellbore 26. The drill string 20 is coupled to a drawworks 30 via a kelly joint 21, swivel 28 and line 29 through a pulley 23. During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38 and the kelly joint 21. The drilling fluid 31 is discharged at the wellbore bottom 51 through an opening in the drill bit 50. The drilling fluid 31 circulates uphole through the annular space 27 between the drill string 20 and the wellbore 26 and returns to the mud pit 32 via a return line 35. A sensor S1 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the wellbore 26.

In some applications the drill bit 50 is rotated by only rotating the drill pipe 22. However, in other applications, a drilling motor 55 (mud motor) disposed in the drilling assembly 90 is used to rotate the drill bit 50 and/or to superimpose or supplement the rotation of the drill string 20. In either case, the rate of penetration (ROP) of the drill bit 50 into the wellbore 26 for a given formation and a drilling assembly largely depends upon the weight on bit and the drill bit rotational speed. In one aspect of the embodiment of FIG. 1, the mud motor 55 is coupled to the drill bit 50 via a drive shaft (not shown) disposed in a bearing assembly 57. The mud motor 55 rotates the drill bit 50 when the drilling fluid 31 passes through the mud motor 55 under pressure. The bearing assembly 57 supports the radial and axial forces of the drill bit 50, the downthrust of the drilling motor and the reactive upward loading from the applied weight on bit. Stabilizers 58 coupled to the bearing assembly 57 and other suitable locations act as centralizers for the lowermost portion of the mud motor assembly and other such suitable locations.

A surface control unit 40 receives signals from the downhole sensors and devices via a sensor 43 placed in the fluid line 38 as well as from sensors 51, S2, S3, hook load sensors and any other sensors used in the system and processes such signals according to programmed instructions provided to the surface control unit 40. The surface control unit 40 displays desired drilling parameters and other information on a display/monitor 42 for use by an operator at the rig site to control the drilling operations. The surface control unit 40 contains a computer, memory for storing data, computer programs, models and algorithms accessible to a processor in the computer, a recorder, such as digital memory (e.g., RAM, ROM, etc.), a tape unit, or other data storage device for recording data and other peripherals. The surface control unit 40 also may include simulation models for use by the computer to processes data according to programmed instructions. The control unit responds to user commands entered through a suitable device, such as a keyboard. The control unit 40 is adapted to activate alarms 44 when certain unsafe or undesirable operating conditions occur.

The drilling assembly 90 also contains other sensors and devices or tools for providing a variety of measurements relating to the formation surrounding the wellbore and for drilling the wellbore 26 along a desired path. Such devices may include a device for measuring the formation resistivity near and/or in front of the drill bit, a gamma ray device for measuring the formation gamma ray intensity and devices for determining the inclination, azimuth and position of the drill string. A formation resistivity tool 64, made according to an embodiment described herein may be coupled at any suitable location, including above a lower kick-off subassembly 62, for estimating or determining the resistivity of the formation near or in front of the drill bit 50 or at other suitable locations. An inclinometer 74 and a gamma ray device 76 may be suitably placed for respectively determining the inclination of the BHA and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. In the above-described exemplary configuration, the mud motor 55 transfers power to the drill bit 50 via a hollow shaft that also enables the drilling fluid to pass from the mud motor 55 to the drill bit 50. In an alternative embodiment of the drill string 20, the mud motor 55 may be coupled below the resistivity measuring device 64 or at any other suitable place.

Still referring to FIG. 1, other logging-while-drilling (LWD) devices (generally denoted herein by numeral 77), such as devices for measuring formation porosity, permeability, mobility, density, rock properties, fluid properties, etc. may be placed at suitable locations in the drilling assembly 90 for providing information useful for evaluating the subsurface formations along wellbore 26. Such devices may include, but are not limited to, acoustic tools, nuclear tools, nuclear magnetic resonance tools, imaging tools, and formation testing and sampling tools. The BHA may include downhole electronics and/or downhole control devices that are part of and/or in communication with the LWD devices 77 and/or other components of the BHA, including, but not limited to, the various tools of the BHA.

The above-noted devices transmit data to a downhole telemetry system 72, which in turn transmits the received data uphole to the surface control unit 40. The downhole telemetry system 72 also receives signals and data from the surface control unit 40 and transmits such received signals and data to the appropriate downhole devices. The downhole telemetry system 72 may be part of and/or in communication with the downhole electronics and/or downhole control devices. In one aspect, a mud pulse telemetry system may be used to communicate data between the downhole sensors and devices and the surface equipment during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. In other aspects, any other suitable telemetry system may be used for two-way data communication between the surface and the BHA 90, including but not limited to, an acoustic telemetry system, an electro-magnetic telemetry system, a wireless telemetry system that may utilize repeaters in the drill string or the wellbore and a wired pipe. The wired pipe may be made up by joining drill pipe sections, wherein each pipe section includes a data communication link that runs along the pipe. The data connection between the pipe sections may be made by any suitable method, including but not limited to, hard electrical or optical connections, induction, capacitive or resonant coupling methods. In case a coiled-tubing is used as the drill pipe 22, the data communication link may be run along a side or inside of the coiled-tubing.

The drilling system described thus far relates to those drilling systems that utilize a drill pipe to conveying the drilling assembly 90 into the wellbore 26, wherein the weight on bit is controlled from the surface, typically by controlling the operation of the drawworks. However, a large number of the current drilling systems, especially for drilling highly deviated and horizontal wellbores, utilize coiled-tubing for conveying the drilling assembly downhole. In such application a thruster is sometimes deployed in the drill string to provide the desired force on the drill bit. Also, when coiled-tubing is utilized, the tubing is not rotated by a rotary table but instead it is injected into the wellbore by a suitable injector while the downhole motor, such as mud motor 55, rotates the drill bit 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* or and receivers 68*a* or 68*b*. Other measurement tools and associated components and/or parts can be disposed as part of the BHA 90, including but not limited to tools for measuring and/or detecting characteristics of a formation or other earth formation, such as electrical resistivity/conductivity, acoustic impedance, bulk density, porosity, permeability, mobility, etc.

Figure 2:
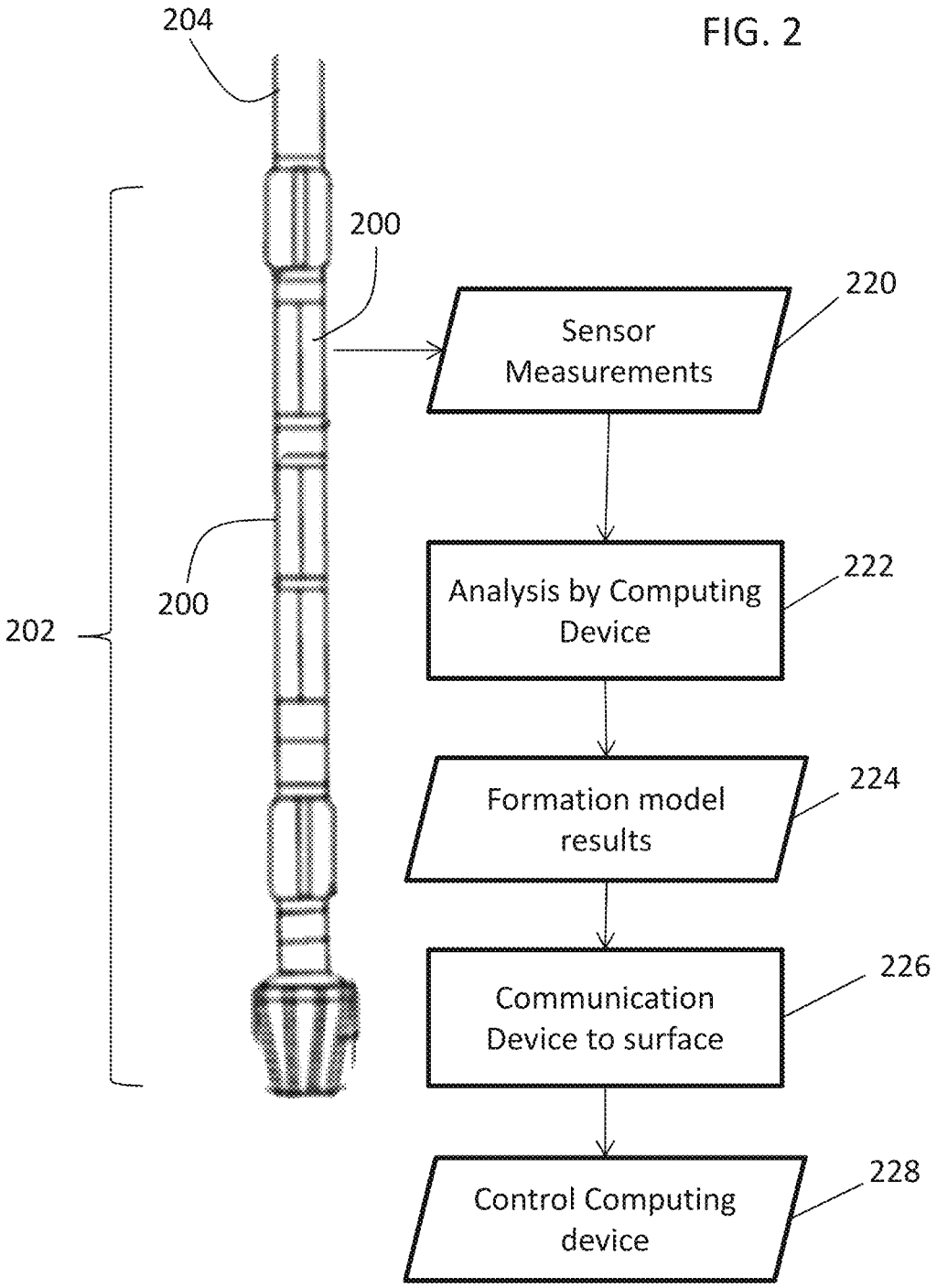
FIG. 2 is a schematic illustration of a downhole tool or bottomhole assembly in accordance with an embodiment of the present disclosure.

In some embodiments, the BHA may include appropriate formation characteristic sensors for enabling answer-while-drilling operations. For example, with reference to FIG. 2, a plurality of sensors 200 are disposed in or on a BHA 202 and/or along a drill string 204. In other embodiments one or more formation characteristic sensors 200 may be at one location or at multiple locations on the drill string 204. Each formation characteristic sensor 200 is configured to measure one or more specific or predetermined characteristic of an earth formation and/or reservoir downhole. The sensors may include sensors and associated components for detecting formation characteristics including, but not limited to, electrical resistivity/conductivity, acoustic impedance, bulk density, porosity, and/or permeability. The plurality of sensors 200 are configured to provide data related to associated formation characteristics to downhole electronics and/or surface computer processing systems (e.g., surface control unit 40 of FIG. 1). The sensors 200 may be a single sensor or multiple sensors.

The data produced by such sensors 200 is shown as sensor measurements and/or data 220. The sensor data 220 is analyzed by a computing device 222 that may be included in the BHA 202 (e.g., in downhole electronics). For clarity, the computing device 222 is shown as external to the BHA 202 but it shall be understood that it may be included in the BHA 202 in one embodiment. In other embodiments, the computing device 222 can be located on the surface (e.g., surface control unit 40 in FIG. 1). Further, in other embodiments, the computing device 222 can be a combination of computing devices located downhole and on the surface. The computing device 222 performs an analysis based on the sensor data 220. The output of this analysis is shown as formation model 224. The formation model can be communicated to the surface (if the sensor data 220 has not already been transmitted to the surface) by a communication device 226. As used herein, a formation model includes basic formation properties such as an apparent resistivity, a slowness value, a gamma value, etc., as a result of a physical measurement. Further, as will be appreciated by those of skill in the art, a conversion from a physical measurement into a formation property may or may not require processing (e.g., convert a voltage into a resistivity), and can be conducted downhole (automatically by firmware algorithms) or at the surface. Upon receiving the modeling, a control computing device 228 (or an operator) can adjust geosteering and/or drilling operations in view of an accurate model of a downhole environment as described herein.

Embodiments provided herein can be employed in answers-while-drilling processes and/or operations (i.e., during drilling and geosteering operations). For example, embodiments provided herein relate to navigating a wellbore through a reservoir (e.g., active drilling and geosteering) by means of conducting multiple measurements and interpreting the measurements to characterize the reservoir around the wellbore in order to make a steering decision. More specifically, some example embodiments provided herein include conducting a resistivity or acoustic measurement to determine reservoir architecture around the wellbore, conducting a hydraulic test using a formation testing tool, and analyzing the hydraulic test results to constrain the reservoir architecture around the wellbore.

Figure 4:
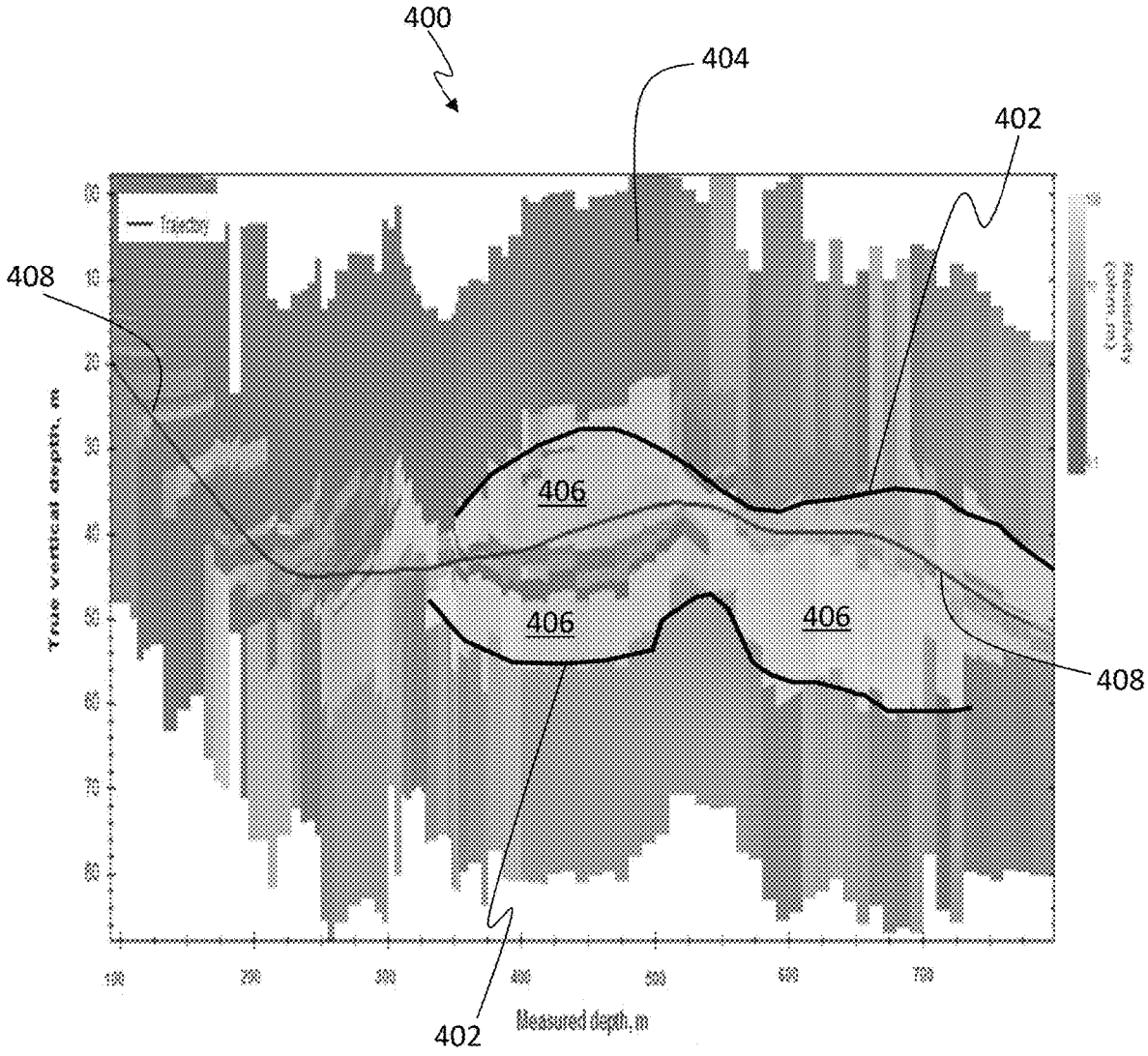
FIG. 4 illustrates a resistivity map derived from a reservoir navigation operation for which a geological model has been inverted to match the measured resistivity logs.

As an example, with reference to FIG. 4, a resistivity map 400 derived from a reservoir navigation operation for which a geological model has been inverted to match the measured resistivity logs is shown. The resulting resistivity map 400 reveals reservoir boundaries 402 between a low-resistive formation 404 (e.g., shale as a caprock) and a highly resistive reservoir 406 (e.g., containing high resistive hydrocarbons). The resistivity map 400 can be used to derive a saturation map using standard or advanced saturation equations such as Archie's equation in combination with a porosity distribution map away from the wellbore 408. An uncertainty in the position of the reservoir boundaries 402 can add uncertainty in an estimation of hydrocarbon reserves around the wellbore 408.

Another drilling operation includes a geo-stopping operation for which the interpretation results of the measurements indicate a situation where the continuation of drilling would either be inefficient in terms of later production from or injection into the wellbore or a hazardous situation may be encountered if drilling is continued. As an example, a fault may be detected by the measurement interpretation so that drilling through the fault may cause the pipe to get stuck in the subsurface. Another example is an over-pressurized reservoir compartment which might cause a kick or a blowout if drilling continues into this over-pressurized zone.

Advantageously, the combined interpretation of hydraulic tests and acoustic and/or resistivity data, as provide herein, can be used to reduce uncertainty of the formation and reservoir properties around the wellbore thus enabling improved drilling and/or geosteering. In contrast, prior solutions involved a single, isolated measurement that can be explained by a large number of formation models. However, embodiments provided herein can reduce the amount or number of models which are able to explain all acquired data (e.g., narrowing the potential field of possibilities based on modeling). In various embodiments provided herein, fitting between the model and the measurements can be either conducted automatically using appropriate inversion algorithms or manually by adjusting model parameters (e.g., forward modeling).

Reservoir navigation or geosteering operations are conducted to optimize high-angle or horizontal (HAHZ) wellbore placement in reservoirs in a way that the well is exposed at a maximum in a hydrocarbon-bearing formation. Reservoir navigation is conducted by measuring formation properties such as the electrical resistivity or conductivity around a wellbore and away from the wellbore. The measurements are then used to identify geological boundaries between a reservoir and other structures such as the cap rock above the reservoir, another geological formation below the reservoir, or fluid contacts within a reservoir.

In accordance with embodiments of the present disclosure, multiple measurements are conducted with different penetration depths away from the wellbore (e.g., outward from the BHA 202 and/or the drill string 204). The measurements obtained downhole by various measurement devices (e.g., sensors 200), each selected to measure one or more specific characteristics of a downhole environment, can be transmitted to the surface (e.g., telemetered using communication device 226 to a surface control unit 40). Other means and mechanisms for communication between the downhole tools and devices and the surface are contemplated as known by those of skill in the art.

The data of the multiple measurements are then used to create a geological model around the wellbore (e.g., wellbore 26), which contains a structural and/or architectural component and a petrophysical property component. The geological model is composed of petrophysical properties such as the electrical resistivity/conductivity, the acoustic impedance, the bulk density, the porosity, the permeability etc., as obtained by the sensors 200. These properties together with the reservoir architecture can then be used to calculate an expected sensor response by formation evaluation tools. Expected sensor responses can then be compared against measured signals from the formation evaluation tools. In some embodiments, the comparison can be done manually such that the geological model is manually refined until it is able to represent the measured signals (i.e., forward modeling). Alternatively, an algorithm can be applied to automatically adjust the geological model unit it is able to represent the measured signals (i.e., inversion modeling). One challenge encountered with these models is their non-uniqueness: different models (about the structures/reservoir architecture and petrophysical properties) can explain the same measurement signals, i.e., multiple models can represent a single measured signal. Thus, constraining the geological model by additional measurements is essential to reduce ambiguities in the geological model.

Another process for detecting boundaries and to evaluate properties within a reservoir is given by hydraulic tests which are usually conducted through production and/or injection wells, as known in the art. Hydraulic tests include producing or injecting fluid from or into a wellbore, ideally at constant flow rates. After production or injection, the well is shut-in and a pressure build-up or drawdown during the shut-in phase is monitored. The recorded pressure response during drawdown or buildup and shut-in phase can then be interpreted using techniques for pressure transients analysis (PTA) such as Homer plots, derivative analyses, log-log plots, etc. The analysis can be conducted analytically or numerically, depending on the complexity of an underlying reservoir model. Hydraulically bounded reservoirs respond different hydraulically compared to reservoirs assumed infinite in extent. As such, an investigation of reservoir architecture is possible with PTA.

Hydraulic tests can be executed using different configurations of test equipment and/or test procedure(s). For instance, a test procedure can include conducting a constant-rate injection or production/drawdown test for which fluid is injected into or produced from a subsurface formation at a constant volume over time. Another hydraulic test can include a step-wise pump rate test where the injection or production/drawdown rate is kept constant over a pre-defined amount of time but is then step-wise increased or decreased for a pre-defined amount of time. Yet another configuration includes an oscillating injection or production/drawdown test for which the injection or production/drawdown rate is oscillated with a certain amplitude and phase. Amplitude and phase may be kept constant or may be variable during the hydraulic test.

Apart from production or injection tests, downhole tools can be equipped in a way that allows hydraulic tests to be performed at dedicated or predetermined positions along a well trajectory. Again, different equipment configurations can be employed to conduct hydraulic tests. For example, formation pressure test devices can attach a pad to a formation wall to inject or produce (drawdown) fluid into/from the formation. Control of the injection/production procedure either automatically or by uphole commands allows conducting similar hydraulic tests as the above mentioned well tests but at dedicated or predetermined locations. In another embodiment, one or more packers can be positioned in a bottom-hole assembly (e.g., BHA 90) to pack-off a portion of the formation and to conduct a dedicated or specific hydraulic test by injecting drilling fluid or other fluid into the packed-off portion of the wellbore using surface pumps or pumps located in or on the bottomhole assembly.

Figure 5A:
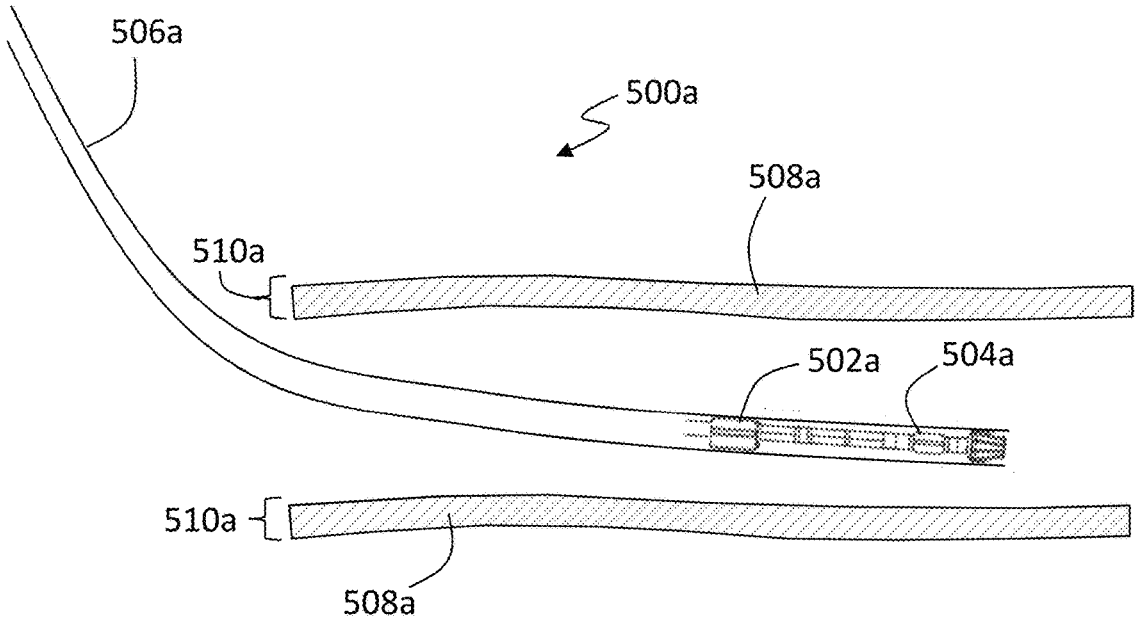
FIG. 5A is a schematic illustration of a downhole tool within a wellbore relative to formation boundaries in a first non-limiting configuration.

The configuration of the test equipment and/or the test procedure can be selected based on a desired resolution and/or accuracy to be obtained from the interpretation of the test. For example, deriving structural information from very deep-reading measurements can provide a large uncertainty to the position of structures such as bed boundaries away from the wellbore, as illustrated in FIG. 5A. A hydraulic test configuration may be selected with similar resolution capabilities. For example, a system 500*a* with a packer 502*a* contained in a bottomhole assembly 504*a* can be used to conduct a hydraulic test over an elongated section of a wellbore 506*a*, with the elongation being defined by the distance between the packer 502*a* and a total depth of the wellbore 506*a*. The interpretation of the hydraulic test can confirm or disconfirm a location of formation boundaries 508*a* within an uncertainty 510*a* of the interpretation results obtained from a deep-reading tool.

Figure 5B:
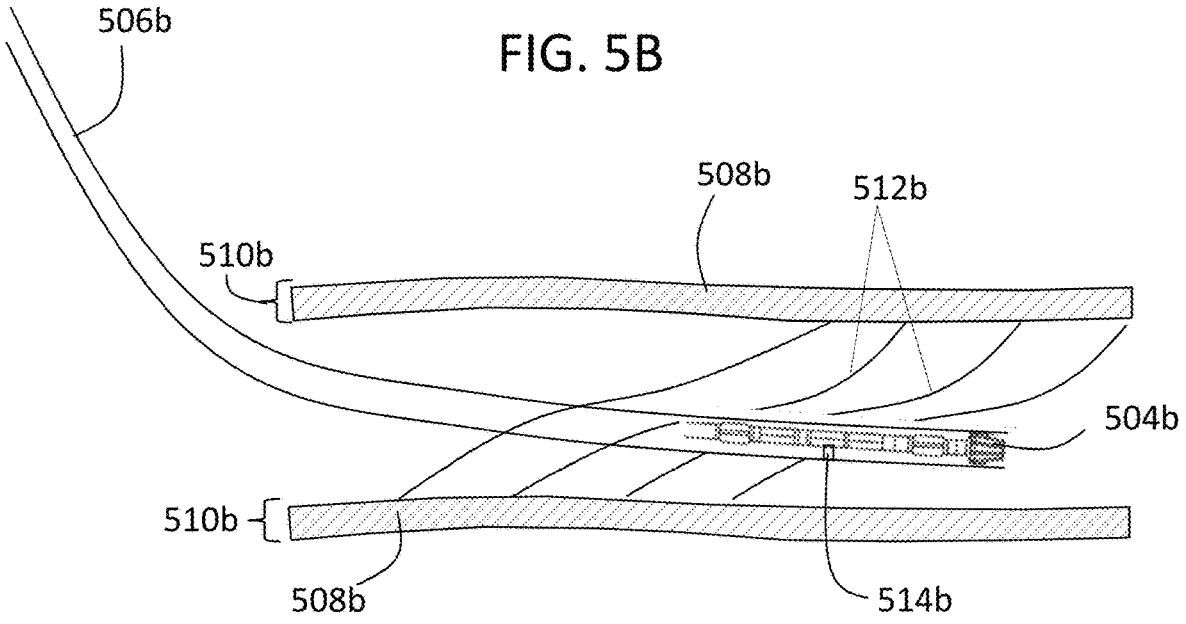
FIG. 5B is a schematic illustration of a downhole tool within a wellbore relative to formation boundaries in a second non-limiting configuration.

As an alternative, as shown in FIG. 5B, an image acquired at or near a wall of the wellbore 506*b* can reveal detailed structural information in the vicinity of the wellbore 506*b*, with the position of the structures being small compared to information obtained from deep-reading measurements. Structures may be reservoir-internal stratigraphic layering 512*b*, as illustrated in FIG. 5B. Accordingly, a hydraulic test configuration may include a formation pressure tester 514*b* configured on a bottomhole assembly 504*b*. The formation pressure test 514*b* can provide localized information of formation boundaries 508*b* (having uncertainty 510*b*) around the wellbore 506*b* and also reveal if stratigraphic layering 512*b* serves as a hydraulic boundary which would not be detectable by a test configuration as described by FIG. 5A.

In view of the above, embodiments provided herein include drilling a wellbore into an earth formation, conducting one or more measurements to evaluate a surrounding of the wellbore, creating a model of the surrounding of the wellbore (e.g., formation), using the model to evaluate a hydraulic behavior of the formation, conducting a hydraulic test using a formation testing and sampling tool, comparing the hydraulic response of the formation model with the hydraulic test, updating the formation model until the measurement and hydraulic test results coincide, and making a reservoir navigation decision. Measurements to evaluate the surrounding formation include, but are not limited to, resistivity, seismic, acoustic, electromagnetic measurements, either azimuthal or circumferential, etc. The created model can be either analytical or numerical, so that the evaluation of the hydraulic behavior of the reservoir can be conducted either by analytical means or numerical simulation. The update of the formation model is either conducted manually by adjusting either properties of the formation or the architecture of the formation (referred to as forward modeling) or by a mathematical operation (referred to as inversion modeling). Different hydraulic tests may be conducted, and the downhole tool may be configured to conduct a test which seems most promising for a specific structural model around the wellbore. For example, a hydraulic test can be conducted using a constant injection/production rate. Alternatively, the injection/production rate can be conducted at multiple different and/or variable rates. Further, an oscillating and/injection/production pattern can be applied to the hydraulic test. A downlink may be sent to the tool to select the test procedure. Accordingly, advantageously, a combination of hydraulic and formation evaluation measurements are used to constrain a geological model around the wellbore and thus provide an improved and accurate estimation of the formation and thus enabled improved drilling operations.

Figure 3:
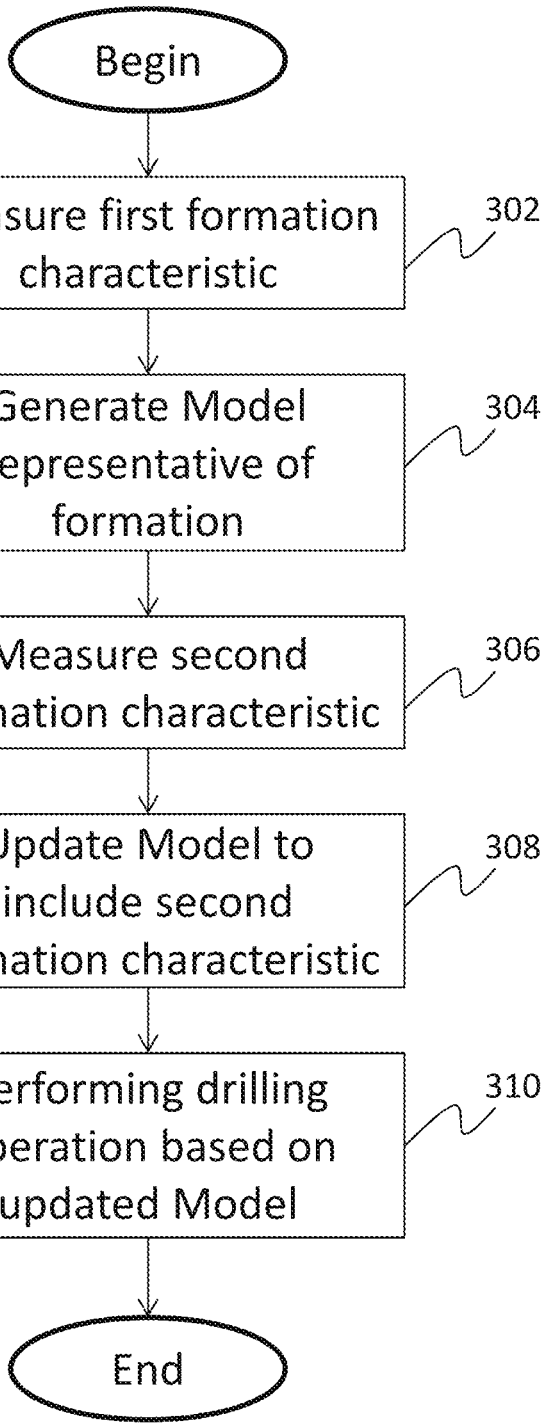
FIG. 3 is a flow process for optimizing drilling operations in accordance with an embodiment of the present disclosure.

FIG. 3 is a flow process of a method for optimizing modeling for drilling operations in a wellbore penetrating the earth with a drill string. Block 302 calls for measuring a first formation characteristic. Non-limiting embodiments of the first formation characteristic include electrical resistivity/conductivity, acoustic impedance, bulk density, porosity, and/or permeability. In one or more embodiments, the sensor is disposed in a bottomhole assembly of the drill string. In one or more embodiments, first formation characteristic is transmitted to a surface device, such as a computing device. In one or more embodiments, the sensor represents a plurality of sensors that may be in one location or a plurality of locations distributed along the drill string. Those of skill in the art will appreciate that the first formation characteristic can comprise multiple formation characteristics and can be obtained from a plurality of different sensors.

Block 304 calls for generating a model representative of the formation. The model is based on the measured first formation characteristic(s). The modeling performed at block 304 may be performed as known in the art. For example, data measured related to the first characteristic can be transmitted to a computing device at the surface and processed to generate one or more models that represent the data of the first characteristic for a downhole formation. The computing device can be connected to a data base and/or memory to store the representative model in the context of a larger Earth model containing an entire hydrocarbon reservoir or even an entire field with multiple hydrocarbon reservoirs. The integration may lead to a refinement of the initial formation model in the context of the Earth model.

Block 306 calls for measuring a second formation characteristic. The second formation characteristic is different from the first formation characteristic. For example, in some non-limiting embodiments, the second formation characteristic is a hydraulic characteristic of the formation surrounding the wellbore. In one or more embodiments, a hydraulic testing tool is disposed in a bottombole assembly (e.g., BHA 90) of the drill string (e.g., drill string 20). In one or more embodiments, second formation characteristic is transmitted to a surface device, such as a computing device. In one or more embodiments, hydraulic testing tool represents a plurality of testing tools that may be in one location or a plurality of locations distributed along the drill string. For example, one pressure pump to inject or produce fluid can be located in a bottomhole assembly and multiple pressure sensors can be distributed along the drill string or bottomhole assembly to monitor a pressure propagation within a formation. Alternatively, a tool can be positioned within the bottomhole assembly and/or in the drill string and moved to various different positions so that a series of hydraulic tests can be conducted along the wellbore. Those of skill in the art will appreciate that the second formation characteristic can comprise multiple formation characteristics and can be obtained from a plurality of different testing tools (or sensors). In some embodiments, the second formation characteristic (and/or the tools to measure such formation characteristic) can be selected based on information related to the first formation characteristic and/or the model generated at Block 304

Block 308 calls for updating the model of Block 304 to include information obtained at Block 306 (e.g., the second formation characteristic). The update of the formation model is either conducted manually by adjusting either properties of the formation or the architecture of the formation (referred to as forward modeling) or by a mathematical operation (referred to as inversion modeling). In some embodiments, the update of the model is performed at or on the computing device on the surface. In some embodiments, the update may be performed on a single, prior model that is adjusted to match the information obtained from the measurement of the second formation characteristic. In other embodiments, the information of the second formation characteristic can be used to eliminate various models from a group of prior generated models (e.g., models generated at Block 304), thus narrowing the number of possible models.

Block 310 calls for performing a drilling operation based on the updated model. That is, based on the refined model(s), a drilling operation can be performed that is most efficient based on the improved modeling achieved by the above described process. The drilling operation can include geo-steering, direction, drilling speed, drilling mud, and/or other aspects of drilling such that optimized and efficient drilling and/or subsequent production or injection from or into the wellbore can be performed. Block 310 can include transmitting selected drilling parameters selected, in view of the modified model, to a drill string controller configured to control the drill string in accordance with the selected drilling parameters The method in FIG. 3 may also include drilling the wellbore with a drilling rig using the selected models in order to improve drilling operations The method may also include controlling one or more drilling parameters using a feedback controller that receives input from a drilling parameter sensor in accordance with a signal received from a processor that selected the drilling parameters that are in accordance with the modified model(s).

Set forth below are some embodiments of the foregoing disclosure:

Embodiment 1: A method for optimizing a drilling operation in a wellbore using a drill string, the method comprising: measuring a first formation characteristic with at least one sensor; measuring a second formation characteristic by means of a hydraulic test, the at least one second formation characteristic being different from the at least one first formation characteristic; generating a model to represent a formation around the wellbore, the model incorporating the first formation characteristic and the second formation characteristic; and performing a drilling operation based on the generated model.

Embodiment 2: The method of embodiment 1, wherein the drilling operation is at least one of a geo-steering operation, a geo-stopping operation, or a safety operation.

Embodiment 3: The method any of the preceding embodiments, wherein the carrier has at least one testing tool configured thereon.

Embodiment 4: The method any of the preceding embodiments, further comprising conveying a carrier through a wellbore into the wellbore, the carrier including the at least one sensor.

Embodiment 5: The method any of the preceding embodiments, wherein the at least one first formation characteristic comprises at least one of electrical resistivity/conductivity, acoustic impedance, bulk density, porosity, or permeability.

Embodiment 6: The method any of the preceding embodiments, wherein the at least one second formation characteristic is a formation boundary.

Embodiment 7: The method any of the preceding embodiments, wherein generation of the model comprises at least one of forward modeling or inversion modeling.

Embodiment 8: The method any of the preceding embodiments, wherein the hydraulic test is performed by a downhole pressure testing tool.

Embodiment 9: The method any of the preceding embodiments, wherein the hydraulic test comprises at least one of conducting a pressure transients analysis or a numerical simulation.

Embodiment 10: The method any of the preceding embodiments, wherein at least one of the second formation characteristic or a configuration of a tool to conduct the hydraulic test are selected based on information related to at least one of the at least one first formation characteristic or the model.

Embodiment 11: The method any of the preceding embodiments, wherein the model is a geological model, the method further comprising updating the model by constraining the geological model.

Embodiment 12: A system for optimizing a drilling operation in a wellbore using a drill string, the system comprising: a carrier configured to be conveyed through a wellbore and carry a drill bit thereon; at least one sensor configured to obtain information related to a first formation characteristic; a hydraulic testing tool configured to obtain information related to a second formation characteristic by means of a hydraulic test; and a processor configured to optimize a drilling operation, the system configured to: measure a first formation characteristic with the at least one sensor; measure a second formation characteristic by means of the hydraulic test, the second formation characteristic being different from the first formation characteristic; generate a model to represent a formation around the wellbore, the model incorporating the first formation characteristic and the second formation characteristic; and perform a drilling operation with the drill bit based on the generated model.

Embodiment 13: The system any of the preceding embodiments, wherein the drilling operation is at least one of a geo-steering operation, a geo-stopping operation, or a safety operation.

Embodiment 14: The system any of the preceding embodiments, wherein at least one of the hydraulic testing tool or the at least one sensor is configured on the carrier.

Embodiment 15: The system any of the preceding embodiments, wherein the first formation characteristic comprises at least one of electrical resistivity/conductivity, acoustic impedance, bulk density, porosity, or permeability.

Embodiment 16: The system any of the preceding embodiments, wherein generation of the model comprises at least one of forward modeling or inversion modeling.

Embodiment 17: The system any of the preceding embodiments, wherein the hydraulic test comprises at least one of conducting a pressure transients analysis or a numerical simulation.

Embodiment 18: The system any of the preceding embodiments, wherein at least one of the second formation characteristic or a configuration of the hydraulic testing tool are selected based on information related to at least one of the first formation characteristic or the model.

Embodiment 19: The system any of the preceding embodiments, wherein the model is a geological model, the system further configured to update the model by constraining the geological model.

The systems and methods described herein provide various advantages. For example, various embodiments provided herein may provide improved and/or efficient completion processes for horizontal wells. Various embodiments can maximize and/or otherwise optimize the location of perforation clusters for completion processes by ensuring locating the perforation cluster at ideal locations for perforation and fracturing.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The terms "first" and "second" do not denote a particular order, but are used to distinguish different elements.

The flow diagram depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A method for optimizing a drilling operation in a wellbore using a drill string, the method comprising:

measuring at least one first formation characteristic with at least one sensor;

measuring at least one second formation characteristic by means of a hydraulic test, the hydraulic test is at least one of producing fluid from and injecting fluid into the wellbore, the at least one second formation characteristic being different from the at least one first formation characteristic;

generating a model to represent a formation around the wellbore, the model initially based on the at least one first formation characteristic and subsequently and automatically updated based on the at least one second formation characteristic; and performing a drilling operation based on the generated and updated model.

2. The method of claim 1, wherein the drilling operation is at least one of a geo-steering operation, a geo-stopping operation, or a safety operation.

3. The method of claim 1, further comprising conveying a carrier through the wellbore, the carrier including the at least one sensor.

4. The method of claim 3, wherein the carrier has at least one testing tool configured thereon.

5. The method of claim 1, wherein the at least one first formation characteristic comprises at least one of electrical resistivity/conductivity, acoustic impedance, bulk density, porosity, or permeability.

6. The method of claim 1, wherein the at least one second formation characteristic is a formation boundary.

7. The method of claim 1, wherein generation of the model comprises at least one of forward modeling or inversion modeling.

8. The method of claim 1, wherein the hydraulic test is performed by a downhole pressure testing tool.

9. The method of claim 1, the method further comprising at least one of conducting a pressure transients analysis or a numerical simulation.

10. The method of claim 1, wherein at least one of the at least one second formation characteristic or a configuration of a tool to conduct the hydraulic test are selected based on information related to at least one of the at least one first formation characteristic or the model.

11. The method of claim 1, wherein the model is a geological model, the method further comprising updating the model by constraining the geological model.

12. A system for optimizing a drilling operation in a wellbore using a drill string, the system comprising:

a carrier configured to be conveyed through the wellbore and carry a drill bit thereon;

at least one sensor configured to obtain information related to at least one first formation characteristic;

a hydraulic testing tool configured to obtain information related to at least one second formation characteristic by means of a hydraulic test, wherein the hydraulic testing tool is a pressure pump to at least one of inject and produce fluid; and a processor configured to optimize a drilling operation, the system configured to:

measure the at least one first formation characteristic with the at least one sensor;

measure the at least one second formation characteristic by means of the hydraulic test, the at least one second formation characteristic being different from the at least one first formation characteristic;

generate a model to represent a formation around the wellbore, the model initially based on the at least one first formation characteristic and subsequently and automatically updated based on the at least one second formation characteristic; and perform a drilling operation with the drill bit based on the generated and updated model.

13. The system of claim 12, wherein the drilling operation is at least one of a geo-steering operation, a geo-stopping operation, or a safety operation.

14. The system of claim 12, wherein at least one of the hydraulic testing tool or the at least one sensor is configured on the carrier.

15. The system of claim 12, wherein the at least one first formation characteristic comprises at least one of electrical resistivity/conductivity, acoustic impedance, bulk density, porosity, or permeability.

16. The system of claim 12, wherein generation of the model comprises at least one of forward modeling or inversion modeling.

17. The system of claim 12, wherein the processor is further configured to at least one of conduct a pressure transients analysis or a numerical simulation.

18. The system of claim 12, wherein at least one of the at least one second formation characteristic or a configuration of the hydraulic testing tool are selected based on information related to at least one of the at least one first formation characteristic or the model.

19. The system of claim 12, wherein the model is a geological model, the system further configured to update the model by constraining the geological model.

* * * * *